United States Patent [19]

Holley et al.

[11] 4,191,214

[45] Mar. 4, 1980

[54] SEQUENTIAL OPERATING MECHANISM FOR VALVES

[75] Inventors: Thomas H. Holley, Richardson; Robert J. George, Dallas, both of Tex.

[73] Assignee: Forney Engineering Company, Carrollton, Tex.

[21] Appl. No.: 922,695

[22] Filed: Jul. 7, 1978

[51] Int. Cl.[2] ..... F16K 31/163

[52] U.S. Cl. ..... 137/630.2; 74/104; 137/238; 251/58; 251/251

[58] Field of Search ..... 74/104; 137/628, 630.2; 251/58, 228, 251

[56] References Cited

U.S. PATENT DOCUMENTS

| | | | |
|---|---|---|---|
| 203,494 | 5/1878 | Perkins | 137/630.2 |
| 3,369,100 | 2/1968 | Kussy | 74/104 |
| 3,507,192 | 4/1970 | Stokke | 74/104 X |
| 3,913,621 | 10/1975 | Damratowski | 137/630.2 |

*Primary Examiner*—Robert G. Nilson

*Attorney, Agent, or Firm*—Marvin A. Naigur; John E. Wilson; John J. Herguth, Jr.

[57] ABSTRACT

Disclosed is a sequential operating mechanism for valves for applications requiring actuation of one valve, or set of valves, prior to actuation of another valve, or set of valves. The equipment preferably includes an actuator driver mounted for powered selective reciprocation through a stroke of selected length. The actuator carries cam pins which engage cams (preferably cam slots) on cam plates attached to the stems of the respective valves during the course of an actuator half stroke. The cams are configured with respect to the paths of movement of the cam pins and with respect to the valve stems so that one valve is fully actuated to its extreme position before actuation of the other valve begins. If additional valves, in the same or different piping networks, require actuation at the same time as one or both of the cam actuated valves, such additional valves are ganged for simultaneous operation with the appropriate one of the cam actuated valves.

11 Claims, 16 Drawing Figures

SEQUENTIAL OPERATING MECHANISM FOR VALVES

BACKGROUND OF THE INVENTION

In many industrial flow systems it is necessary to actuate one valve completely and positively before another valve is actuated in order to prevent undesirable mixing or back-mixing of streams which, in different stages of an operating sequence, may pass through the same lines. For example, in boiler installations, it is common to use product steam or air to purge liquid fuel burners upon shut-down, and as an atomizing fluid in air or steam atomized burners. If, because of imprecise timing of the actuation of valves controlling steam or air flow and fuel oil flow, oil gets into the steam piping system or condensate gets into the fuel supply, a most undesirable and even dangerous situation can result.

In the past, 90° ball valves have been ganged to a single actuator in an effort to operate all necessary valves simultaneously, but this produces the objectionable "cross-over" or "blending" outlined above. The standard valve port openings are so large that both valves of a pair are partially open for some period of time, even when an effort is made to operate them simultaneously. Furthermore, there is a possibility that jamming or other failure of the actuator part way through a stroke may leave both oil and steam valves open for lengthy time periods. Separate actuators and separate electric or pneumatic operators and control systems for valves result in complex equipment arrangements, are subject to failures, and have no positive mechanical interlocks to provide assurance that valve sequencing is properly accomplished.

CERTAIN PRIOR ART

Harvey et al U.S. Pat. No. 3,752,421 discloses a device for converting linear motion to oscillating motion in the context of model airplane landing gear. A reciprocating member engages a slotted member which pivots about an axis. Surfaces on the slotted member engage the reciprocating member to act as locks in the "gear up" and "gear down" positions. Several devices may be ganged together for simultaneous operation.

Kussey et al U.S. Pat. No. 3,369,100 discloses a mechanism for selectively operating one of two devices in the context of key-operated electric motor starters. It includes a reciprocating actuator having two slots therein engaging switch pins. The slots are configured to operate one switch upon movement of the acutator in one direction while holding the other in an off position, and vice versa.

Stokke U.S. Pat. No. 3,507,192 discloses a rectilinear valve actuator in which an actuator pin engages a slotted lever arm attached to a valve shaft and having locking surfaces at the ends of throw positions.

McPherson U.S. Pat. No. 3,570,835 shows a clamping device including a linear actuator and a pivotal element having a slot therein engaging the actuator.

Sheesley U.S. Pat. No. 3,704,986 is examplary of many patents disclosing linear pin actuators for rotary valves.

SUMMARY OF THE INVENTION

In accordance with the invention there is provided a sequential operating mechanism for valves which overcomes the problems outlined above by sequentially actuating one valve completely before initiating and completing actuation of another. In its preferred form, the invention comprises an actuator block which is mounted for reciprocation in a path which passes adjacent the stems of two or more valves which require sequential operation. The actuator block has a pair of cam pins mounted thereon, and power-means, such as a double-acting pneumatic piston and cylinder, and provided for driving the actuator block back and forth along its path of reciprocation.

Each valve stem has a cam plate mounted thereon in a position to be engaged by a cam pin moving past the valve stem. The cam plates are provided with camming surfaces, preferably in the form of slots, which are configured with respect to the paths of movement of the cam pins and with respect to the positions of the valve stems, as well as their angles of rotation between closed and open, so that upon a half-stroke of the actuator block one valve is completely actuated before actuation of the other begins, and both valves are fully actuated during the course of a half-stroke.

Preferably, the actuator block and the cam plates are mounted within a protective housing which also serves as the mounting means for the power mechanism for the actuator block. One of the valve stems may carry a switch operator for operating limit switches in the power means control system.

If the particular piping network or networks involved include additional valves which must be operated simultaneously with one or the other of the two valves which are directly acted upon by the actuator block, then in accordance with the invention, their stems are ganged with the appropriate primary valve by means of rods and levers, additional cam mechanisms, or other linkages. Practical layout considerations place some limitation upon the total number of valves which may be operated from a single actuator block; in the accompanying drawings a five valve system is illustrated, but a somewhat larger number may be accommodated.

From the foregoing, it can be seen that the principal objects of the invention are to provide a sequential valve operating mechanism which is simple and rugged in construction, compact and economical, reliable in operation, and substantially fail-safe by reason of positive mechanical interlocks between the associated valves.

The manner in which the foregoing objects, together with other objects and purposes, are achieved may best be understood by a consideration of the detailed description which follows, together with the accompanying drawings.

DESCRIPTION OF THE PREFERRED EMBODIMENTS

Figure 1A:
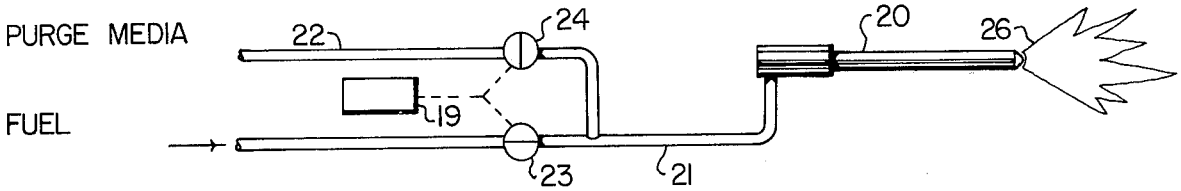
FIGS. 1A and 1B are sequential diagrammatic illustrations of a burner and associated piping and valves equipped with the valve operating mechanism of the invention, the burner being of the mechanically atomized type with no separate atomizing media, and with provision for purging upon shut-down, and the network involving two valves.
Figure 1B:
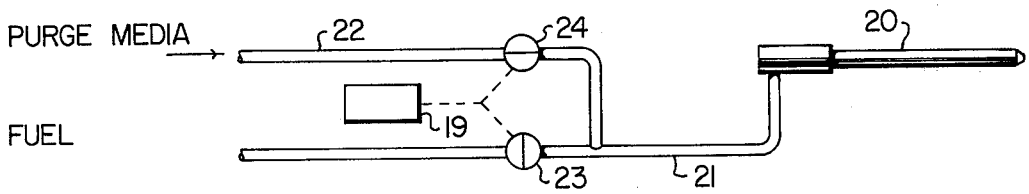

Attention is first directed to FIGS. 1A and 1B, which show a burner 20 of the mechanically atomizing type equipped with a fuel feed line 21 and a purge line 2 connected into the fuel line upstream from the burner. Line 21 has a fuel flow valve 23 therein and line 22 has a purge valve 24 therein. A valve operating mechanism of the invention 19 is connected to both valves. These FIGS. thus show the invention employed in a two valve piping network or system.

FIG. 1A shows the burner 20 in its fired condition, a flame being indicated at 26. Fuel valve 23 is open and purge valve 24 is closed, with fuel oil flowing through line 21 to the burner. Upon shut-down of the burner, valve operating mechanism first closes fuel valve 23 to completely stop flow of fuel in line 21. It then opens purge valve 24 to admit steam or another purging fluid from line 22 into line 21 downstreams from valve 23 to force the fuel out of the portion of line 21 lying between the junction of lines 21 and 22 and the burner, and out of the burner itself. This condition is shown in FIG. 1B. If it is desired to terminate the purging without restarting fuel flow, a valve in line 22 upstream from the equipment shown in the FIGS. may be closed. But if it is desired to re-fire the burner immediately upon completion of purging, operating mechanism 19 is actuated in the opposite direction to close valve 24 completely and then open valve 23 to restore fuel flow. The equipment is thus returned to the configuration shown in FIG. 1A.

From the foregoing it can be seen that by sequencing the operation of valves 23 and 24, the opportunity for the fuel to back-mix or cross over into the purge line is substantially eliminated, as is the chance for the purge fluid to work its way into fuel line 21 upstream of valve 23.

Figure 2A:
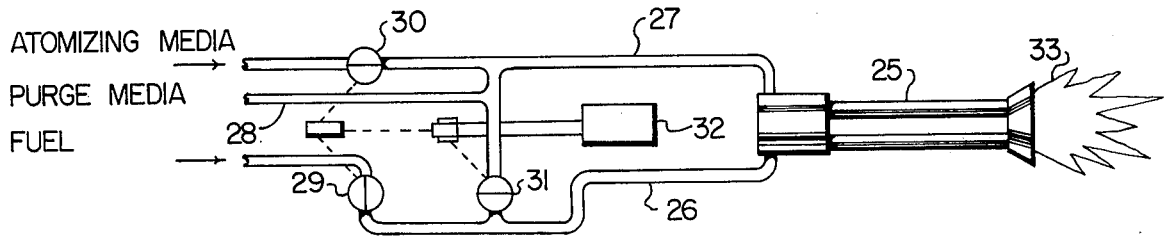
FIGS. 2A and 2B are sequential diagrammatic illustrations of a burner and associated piping and valves equipped with the valve operating mechanism of the invention, the burner being of the type utilizing a separate atomizing media, and with provision for purging upon shut-down, and the network involving three valves.
Figure 2B:
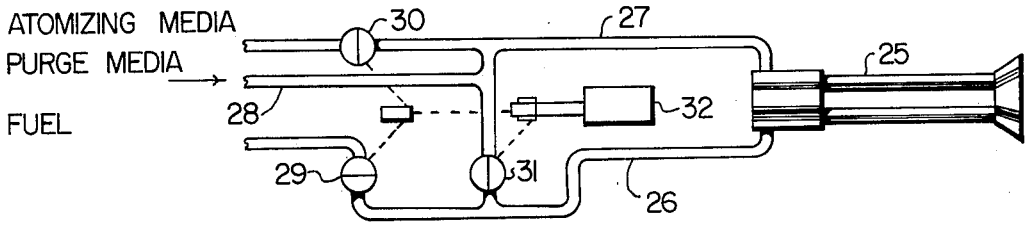

A burner system employing three valves is shown in FIGS. 2A and 2B. Burner 25 is of the media assist atomizing type in which steam or air is mixed with the fuel oil to propel it voilently through the burner nozzle to break the fuel up into fine streams or particles. Fuel is fed to the burner through line 26, and purging media through line 27. Purge media is introduced through line 28, which branches into both lines 26 and 27. Normally the purge media and the atomizing media are the same material, but at different pressures and flow rates or at least compatible materials. Fuel valve 29 is mounted in line 26, atomizer valve 30 in line 27, and purge valve 31 in the branch of line 28 leading to the fuel line. A valve operating mechanism of the invention 32 is connected to all three valves.

FIG. 2A shows the burner 25 in its fired state, with a flame indicated at 33. Valves 29 and 30 are open, allowing fuel and atomizing fluid to flow to the burner. Purge valve 31 is closed. To shut the burner down and purge it, valve operator 32 is actuated to first simultaneously close valves 29 and 30, and then open purge valve 31. Purging fluid flows through both the fuel line 26 and the atomizing line 27 to the burner, as shown in FIG. 2B. Actuation of operator 32 in the opposite direction shuts off the purge before re-opening the fuel and atomizing media lines.

Figure 3A:
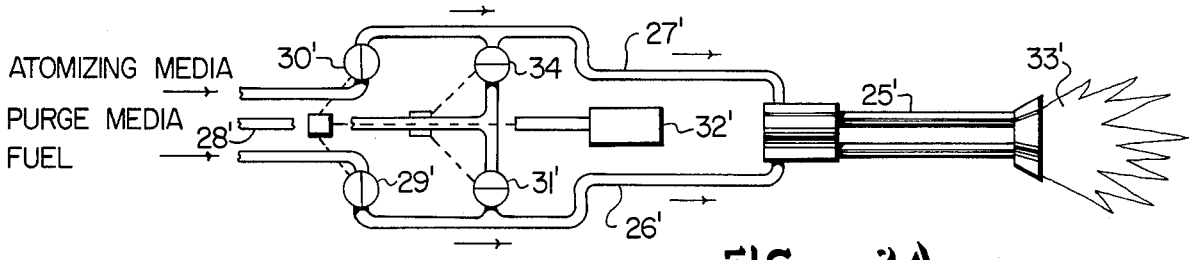
FIGS. 3A and 3B are sequential diagrammatic illustrations of a burner and associated piping and valves equipped with the valve operating mechanism of the invention, the burner being of the media assist atomizing type with provision for purging upon shut-down, and the network involving four valves.
Figure 3B:
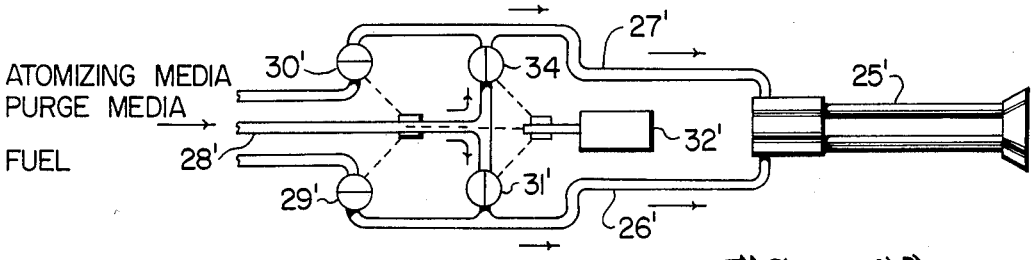

The equipment shown in FIGS. 3A and 3B is very similar to that shown in FIGS. 2A and 2B, except that an additional valve is employed, making a total of four. For this reason, the same reference characters are employed as in FIGS. 2A and 2B (with primes added) for corresponding parts.

The added valve is designated 34, and it is located in the branch of purge line 28′ leading to atomizing line 27′. In this way provision is made to isolate the purge and atomizing streams, making it unnecessary for them to be of the same material or compatible materials.

When the burner is firing, as is shown in FIG. 3A valves 29′ and 30′ are open, and both valves 31′ and 34 are closed, isolating the purge line 28′. When burner shut-down and purge is desired, valve operator 32′ first closes valves 29′ and 30′ simultaneously, and then opens purge valves 31′ and 34 simultaneously. The sequence is reversed to re-fire the burner.

Figure 4A:
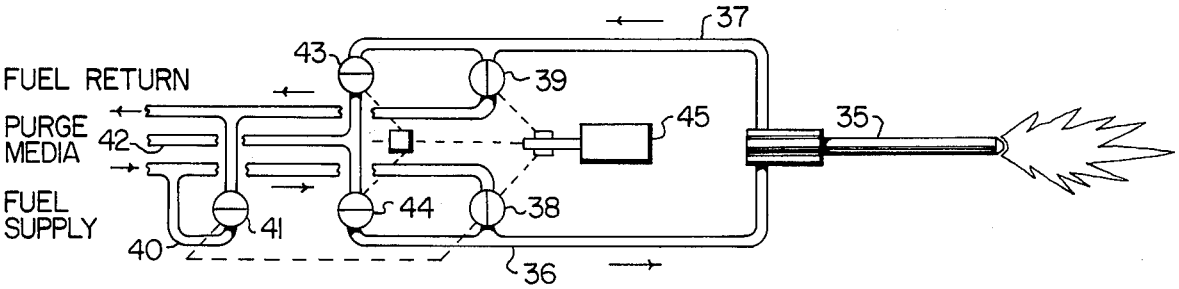
FIGS. 4A and 4B are sequential diagrammatic illustrations of a burner and associated piping and valves equipped with the valve operating mechanism of the invention, the burner being of the media assist atomizing type with provision for purging upon shut-down, and recycling of fuel flow, and the network involving five valves.
Figure 4B:
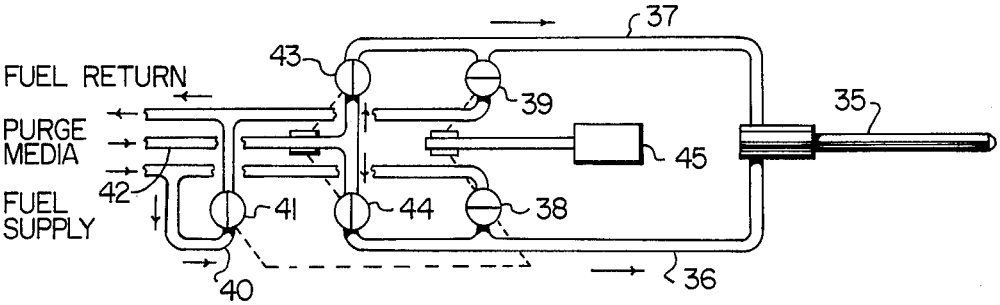

A five-valve system is shown in FIGS. 4A and 4B. Burner 35 is connected to fuel feed line 36 and to fuel return line 37 so that fuel may be circulated both toward and away from the burner. Valve 38 is mounted in the feed line and valve 39 in the return line 37 upstream of valves 38 and 39. A by-pass valve 41 is mounted in line 40. Purge line 42 branches to connect to both lines 36 and 37. Purge valves 43 and 44 are mounted in the branches of line 42. A valve operating mechanism of the invention 45 is connected to all five valves.

With the burner 35 firing, valves 38 and 39 are open to permit both feed and return of fuel. By-pass valve 41 and purge valves 43, 44 are closed. This situation is shown in FIG. 4A. Upon burner shut down, operator 45 first closes valves 38 and 39 and opens by-pass valve 41, and then opens purge valves 43, 44 to admit purging fluid to the feed line, the return line, and ultimately, burner 35. The valve operating sequence is reversed for re-firing the burner.

From the foregoing it can be seen that the sequential valve operating mechanism of the invention may be utilized with a variety of piping and valving schemes for the purpose of preventing cross-over or blending of streams which should be kept separate.

Figure 5:
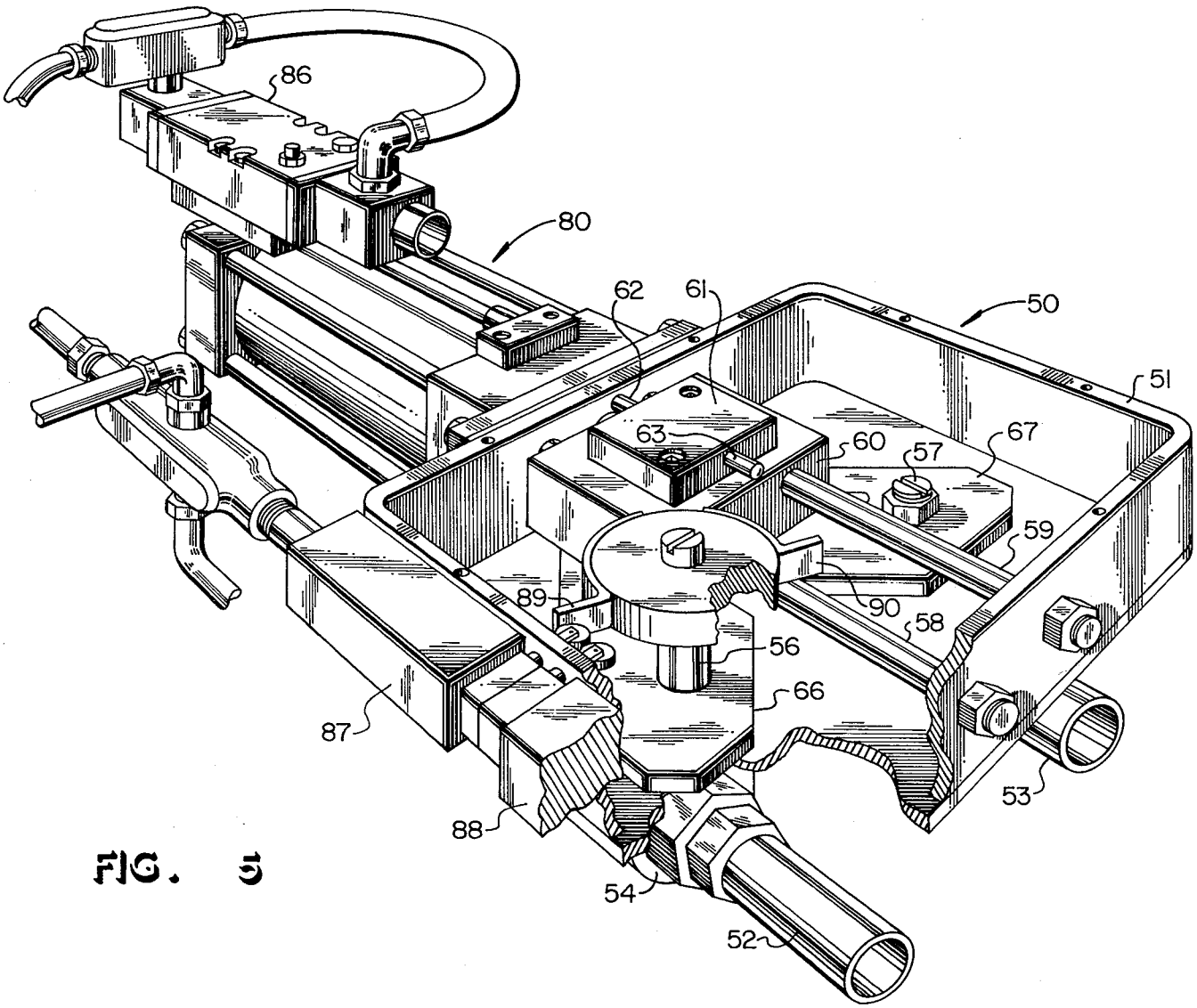
FIG. 5 is a perspective view, on an enlarged scale, and partly broken away, of a sequential valve operating mechanism for two valves constructed in accordance with the invention.
Figure 6:
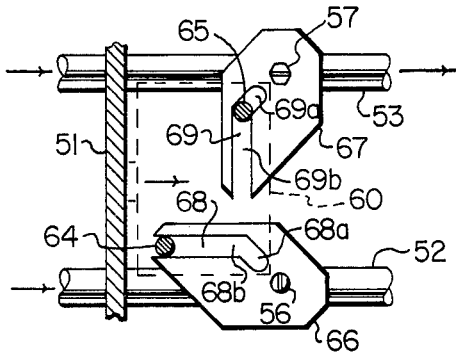
FIG. 6–10 are diagrammatic partial plan views of the valve operating mechanism of FIG. 5, on a reduced scale as compared to that FIG. showing the sequence of operation.
Figure 7:
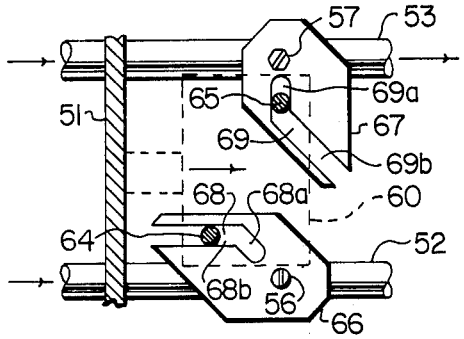
Figure 11:
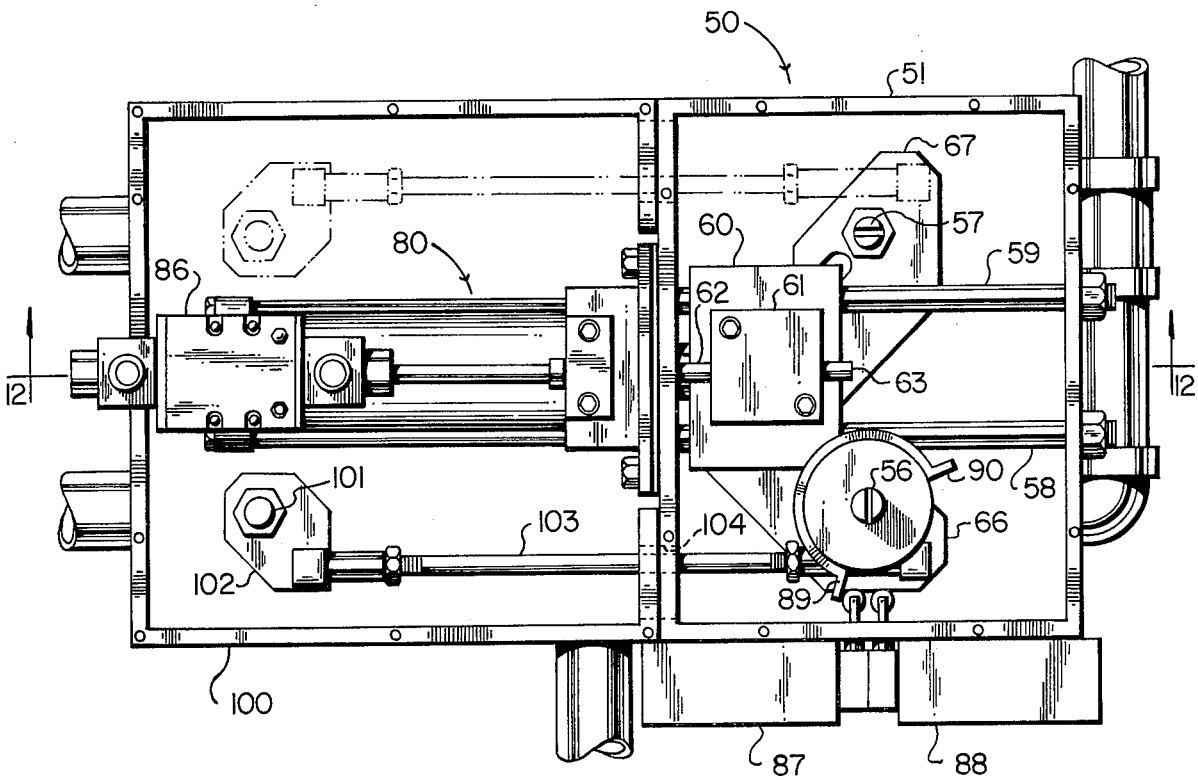
FIG. 11 is a plan view of a valve operating mechanism of the invention modified to handle three valves.
Figure 12:
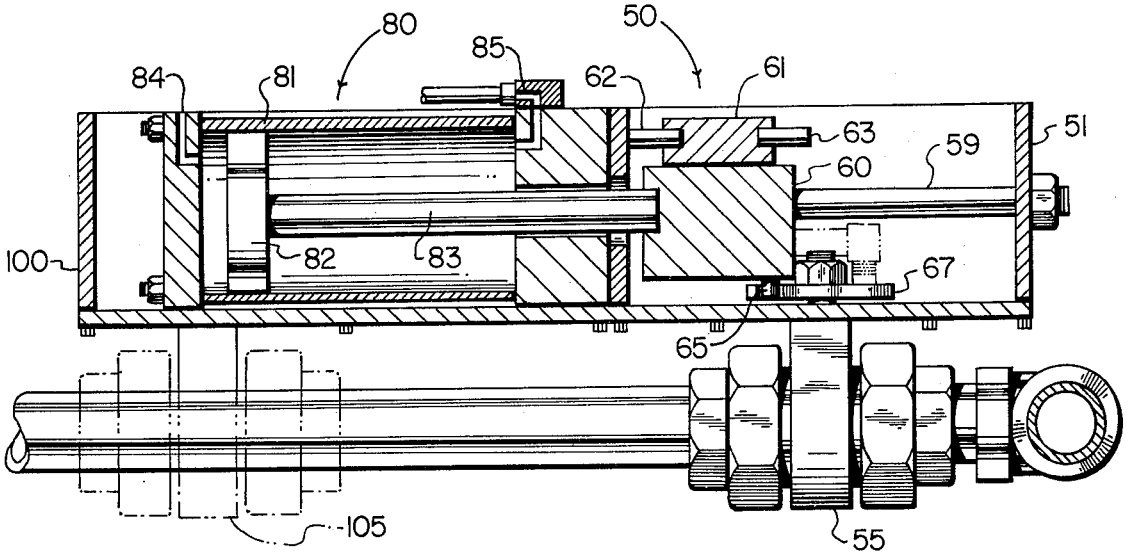
FIG. 12 is a sectional elevational view of the mechanism of FIG. 11, the section being taken on the line 12—12 of FIG. 11.

Attention is now directed to FIGS. 5, 6, 11 and 12. FIG. 5 shows a unit of the invention designed and equipped to sequentially actuate two valves, for application in a system such as that shown in FIGS. 1A and 1B. FIGS. 11 and 12 shown this same unit with parts added to enable it to handle three valves, as are required in the system of FIGS. 2A and 2B. In dotted outline on FIGS. 11 and 12 there is shown the still further equipment needed to operate a four valve system such as that of FIGS. 3A and 3B. FIG. 6 is referred to because it shows the configuration of the cam plates of the invention more clearly than the other FIGS.

In these FIGS. the basic sequential valve operating mechanism of the invention is designated generally as 50. It includes a box-like housing 51, which is desirably provided with a cover plate that is omitted from the drawings for purposes of clarity in illustration. The housing 51 is positioned above two flow lines 52, 53, each of which contains a 90° ball valve 54 (FIG. 5) and 55 (FIG. 11). The stems 56, 57 of valves 54, 55 extend through openings in the floor of housing 51 into the interior thereof.

A pair of parallel guide rods 58, 59 extend across the interior of housing 51. Actuator block 60 is slidably mounted for reciprocating rectilinear movement on the guide rods. A positioning block 61 is attached to the top of the actuator block. On opposite faces of the block limit pins 62 and 63 are mounted. By engaging the side walls of housing 51, pins 62 and 63 define the position and length of a back-and-forth stroke of actuator block 60. Preferably, pins 62 and 63 are threaded into block 61 to provide adjustablility.

On the bottom of actuator block are mounted downwardly extending cam pins 64, 65, best seen in FIGS. 6 and 12. A cam plate 66 is mounted on valve stem 56 and a similar cam plate 67 is mounted on valve stem 57. These appear most clearly in FIG. 6, from which it can be seen that plate 67 has a generally dog-legged cam slot 68 therein, and plate 67 has a similar slot 69 therein. Pin 64 is slidingly engaged in slot 68 and pin 65 is slidingly engaged in slot 69.

A further consideration of FIG. 6 will reveal that each slot has two sections: a closed ended section 68*a*, 69*a* and an open ended section 68*b*, 69*b*. The "a" section of each slot is aligned on a line passing through the stem of its associated valve, and the "b" section of each slot is oriented perpendicular to the gate of its associated valve.

Power means designated generally as 80 in FIGS. 5, 11, and 12 are provided for moving actuator block 60 back and forth in its path of travel. The power means include pneumatic cylinder 81 with piston 82 therein, the rod 83 of which is connected to actuator block 60, as can be seen from FIG. 12. Fluid inlet ports 84, 85 are provided at the ends of cylinder 80, and a pneumatic controller 86, of known type directs compressed air through them against one face or the other of piston 82 in response to control signals. Some of these signals may be provided by limit switches 87, 88, which are mounted on a side of housing 51 with their switch operators extending into the housing in position to be thrown by tabs 89, 90, on disk 91, mounted on valve stem 56. In this manner end-of-stroke signals may be generated for use directly or indirectly by controller 86.

It should be understood that while pneumatic power means are shown for moving the actuator block, other suitable means, including hand-powered means, may be employed.

The manner in which the capability for actuating additional valves is provided is shown in FIGS. 11 and 12. An additional housing 100 is mounted on the left side of main housing 51. Power means 80 may conveniently be contained substantially wholly within it. An additional or third valve is provided, only the stem 101 of which appears in FIG. 12. A crank plate 102 is attached to stem 101. Crank plate 102 is ganged to cam plate 66 for unified rotating movement therewith by rod 103, which passes through an opening 104 in housings 51 and 100, and is pivotally connected to both plate 66 and plate 101. Thus the third valve will be operated whenever valve 54 is operated.

Provision is made for a fourth valve 105, shown in dotted outline in FIG. 12, in the same general manner, as indicated by the dotted outlines in FIG. 11, showing that the fourth valve is ganged to operate with valve 54, whose stem is 57.

It should be noted that additional valves may be added to the system by adding housings similar to 101 to additional sides of main housing 51. If the disadvantages of having the mechanism unprotected by a housing are considered acceptable, the housings may be omitted, and the additional valves merely placed around housing 51 and as close to it as convenient.

Attention is now directed to FIGS. 6–10, which are a series of sequential diagrammatic illustrations designed to show the mode of operation of the invention. It should be noted that in these FIGS. as well as in others, valve stems 56 and 57 are slotted at their ends to provide indicators of the position of the valve gate.

Figure 8:
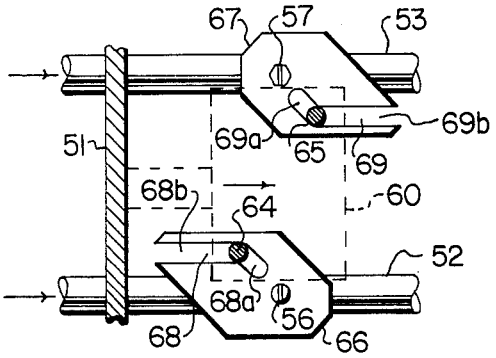
Figure 9:
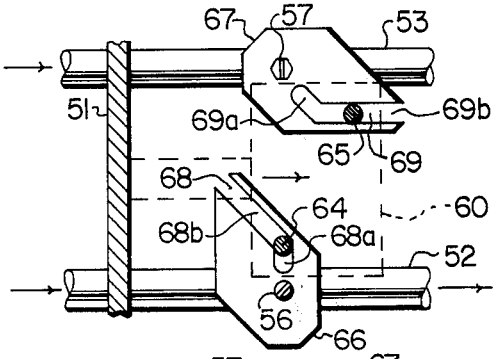

In FIG. 6 the valve in line 53 is open and the valve in line 52 is closed. Block 60 is shown starting to move toward the right. As it does so pin 65 works against the walls of slot 69*a* to turn the valve in line 53 toward the closed position. See FIG. 7. However, pin 64 is merely moving up slot 68*b*, without turning plate 66. Eventually block 60 moves far enough to the right to complete closure of the valve in line 53, and is shown in FIG. 8. As can be seen in that FIG. pin 65 moves into the "b" portion of slot 69, and thus no longer exerts a turning force on plate 67.

The opening of the valve in line 52 now commences. (FIG. 8) Pin 64 starts to enter the "a" portion of slot 68 where it engages plate 66 to turn it to start opening of the valve. This process continues through the stage shown in FIG. 9 to the end point shown in FIG. 10.

Figure 10:
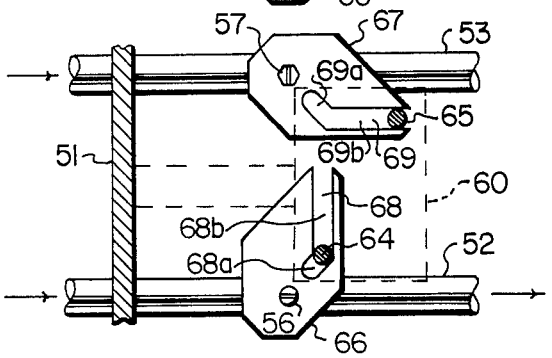

The mode of operation of the equipment when the activator block 60 is moved in a half stroke from right to left may be understood by considering FIGS. 6–10 in reverse order, starting with FIG. 10 and working back to FIG. 6. Such movement first closes the valve in line 52 and then opens the valve in line 53. If desired, the equipment may be stopped with the parts in the position shown in FIG. 8, i.e., with both valves fully closed, during a half-stroke in either direction, and movement may be restarted in either direction.

What is claimed is:

1. Apparatus for sequentially operating a pair of adjacent valves comprising:

a first cam plate fixed to the stem of a first valve;

a second cam plate fixed to the stem of a second valve;

actuator means having a pair of cam pins thereon, one of said cam pins being engagable with said first cam plate and the other of said cam pins being engagable with said second cam plate;

guide means for said actuator means establishing a path of movement therefor, said path of movement being rectilinear and extending past both of said cam plates; and means for moving said actuator means back and forth along said path of movement;

said cam plates each being provided with camming surfaces thereon configured with respect to the path of movement of said actuator block, the position of said cam pins thereon, and the positions of said valve stems so that upon movement of said actuator means along said path of movement in one direction, one of said valves is completely actuated before actuation of the other of said valves begins, and both valves are fully actuated during the course of said movement.

2. Apparatus in accordance with claim 1 and further comprising means linking a third valve to said first valve for simultaneous operation therewith.

3. Apparatus in accordance with claim 2 and further comprising means linking a forth valve to said second valve for simultaneous operation therewith.

4. Apparatus in accordance with claim 1 and further comprising means for linking a plurality of valves to one of said valves for simultaneous movement therewith.

5. Apparatus in accordance with claim 1 in which said camming surfaces are cam slots formed in said cam plates.

6. Apparatus in accordance with claim 5 in which said cam slots are generally dog-legged.

7. Apparatus in accordance with claim 5 in which said cam slots are open ended at one end.

8. Apparatus in accordance with claim 1 in which said cam slots are each formed in two contiguous sections, the first of said sections being aligned on a line passing through the stem of its associated valve, and the second of said sections being oriented perpendicular to the gate of its associated valve.

9. Apparatus in accordance with claim 1 and further comprising means for defining the position and length of a back-and-forth movement of said actuator means.

10. Apparatus in accordance with claim 9 and further comprising a housing surrounding the path of movement of said actuator means and said actuator means, and in which said position and length defining means comprise limit pins adjustably mounted on said actuator means for engagement with said housing at the end of a stroke.

11. Apparatus in accordance with claim 1 in which the means for moving said actuator means are power operated, and further comprising limit switches sensing the open and closed positions of one of said valves for generating control signals for said power means.

* * * * *